US005873265A

United States Patent [19]

Simonnet

[11] Patent Number: 5,873,265

[45] Date of Patent: Feb. 23, 1999

[54] ROTATING MOUNT STRUCTURE FOR THE PRESENTATION OF DECORATIVE ELEMENTS

[76] Inventor: Francis Simonnet, 16, rue de Meudon, Clamart, France, 92140

[21] Appl. No.: 645,676

[22] Filed: May 14, 1996

[30] Foreign Application Priority Data

Apr. 17, 1996 [FR] France ..... 96 04807

[51] Int. Cl.[6] ..... A44C 17/02

[52] U.S. Cl. ..... 63/28; 63/31

[58] Field of Search ..... 63/26, 28, 29.1, 63/30, 31, 11, 2, 3

[56] References Cited

U.S. PATENT DOCUMENTS

| | | | |
|---|---|---|---|
| 1,654,335 | 12/1927 | Lindroth | 63/28 |
| 2,453,955 | 11/1948 | Younghusband | 63/15 |
| 3,483,716 | 12/1969 | Stenzler | 63/28 |
| 4,796,442 | 1/1989 | Sarcona | 63/28 |

FOREIGN PATENT DOCUMENTS

| | | |
|---|---|---|
| 18558 | 5/1914 | France . |
| 2192331 | 2/1974 | France . |
| 8908082.6 | of 1989 | Germany . |
| 465296 | of 1968 | Switzerland . |
| 762204 | 11/1956 | United Kingdom . |

*Primary Examiner*—Kien T. Nguyen
*Attorney, Agent, or Firm*—Zarley, McKee, Thomte, Voorhees, & Sease

[57] ABSTRACT

The invention aims to produce an effect of renewing the presentation of decorative objects, making it possible continually to derive benefit from the objects presented. To do this, it is proposed to employ rotating-mount structure combined with an opening in order to produce a mount which reveals different decorational motifs in succession. The rotating-mount structure includes a hoop (1) with central symmetry (Ω), composed of an external face ($F_e$) and two lateral faces ($F_1$) which are symmetric with respect to a mid-plane, the two lateral faces ($F_1$) forming, as a border, a cylindrical opening. An opening (O) is made in the external face ($F_e$) in order to reveal a window which extends principally in the mid-plane of the figure and defines a given angular sector (A). Carriers (11 to 14) for the objects (4) to be presented are shaped in such a way as to be housed in the pits of the hoop after juxtaposition via uniting faces ($F_a$, $F_b$). An inner ring (B) is dimensioned so as to engage against the said cylindrical opening and is secured to the rotating mount.

11 Claims, 2 Drawing Sheets

ROTATING MOUNT STRUCTURE FOR THE PRESENTATION OF DECORATIVE ELEMENTS

BACKGROUND OF THE INVENTION

The invention relates to the presentation of decorative objects, for example to the presentation of precious stones or of particular motifs, arranged on a base of substantially annular design, and concerns more particularly the field of jewelry. It can also be applied to related fields in which the decoration acts as complementary element: spectacle making, watch making, etc.

Traditionally, objects such as rings, bracelets, earrings, broaches, necklaces, etc., are decorated either by means of precious stone settings, or by engraving particular motifs or inscriptions.

These decorations are definitive and, after the infatuation and the novelty effect which follows purchase, the object loses is attraction and becomes commonplace. To remedy this defect, certain means have already been proposed which make it possible to modify the appearance of jewels.

A category of so-called "masked" or "concealed" jewels is in fact known which reveal stones by opening masking means surrounding the jewel. This type of construction includes hinge-mounted removable opening/closing means.

The means used to construct masked jewels offer merely one possible alternative and, moreover, the appearance of the stones is made commonplace by the use of closing/opening type means with which the cases or boxes for storing articles of jewelry are conventionally equipped.

These means do not make it possible definitively to solve the stated problem, that is to say the employing of means capable of actually renewing the presentation of decorative elements, engendering the desired attractive effect.

SUMMARY OF THE INVENTION

The invention aims to solve this problem by proposing rotating means combined with an opening in order to produce a mount making it possible to obtain successive appearances of different decorational motifs, inside a fixed window. These appearances are then more akin to "display" type presentation, making it possible to benefit from the renewed ceaseless attraction due to the kind of "magnetism" exerted by this type of appearance within a defined and limited space.

More precisely, the subject of the invention is a rotating-mount structure for the presentation of decorative elements including support means for these decorative elements and an annular base, wherein the annular base is a partially and substantially toric pitted hoop with central symmetry, composed of an external face and of two lateral faces which are symmetric with respect to amid-plane, said two lateral faces forming, as a border, a cylindrical opening, wherein at least one opening is made in said external face in order to reveal a window which extends along a circular principal axis lying in said mid-plane of symmetry and defining a given angular sector, wherein the support means are composed of several distinct carriers shaped to be able to be housed in the pits of the hoop after juxtaposition and to constitute a rotating mount in order to present the decorative elements in succession through said window, and wherein an inner ring dimensioned so as to engage against the cylindrical opening, is secured to said rotating mount.

Advantageously, at least one of the lateral faces is furnished with indexing means cooperating with means secured to the carriers of the decorative elements for the successive and defined presentation of sets of decorative elements.

According to a preferred embodiment, the indexing means consist of opposing notches arranged on each lateral face of the hoop, the number and distribution of these notches being dependent on the sets of decorative elements which it is desired to present simultaneously, cooperating with elastic pressure means secured to the carriers coming into elastic abutment in these notches.

Preferably, the elastic pressure means consist of a spring flanked by two balls, the spring/balls assembly being dimensioned so as to be able to be introduced into a bore formed in at least one of the carriers. Preferably also, in order to secure the inner ring to the rotating mount, the former exhibits a fixing point for each carrier.

In a particular embodiment, the structure according to the invention is applied to a stone-lined ring; it includes four carriers set with stones of identical or varied colours, and exhibits a window of angle equal to around 120°.

According to another particular embodiment concerning a gold ring, the carriers exhibit a face on which the gold is engraved so as to constitute different or complementary motifs, and the angle of opening of the window is also substantially equal to 120°.

BRIEF DESCRIPTION OF THE FIGURES

Other characteristics and advantages of the invention will emerge on reading the detailed description which follows, with reference to the appended figures which represent respectively.

DESCRIPTION OF THE PREFERRED EMBODIMENT

Figure 1:
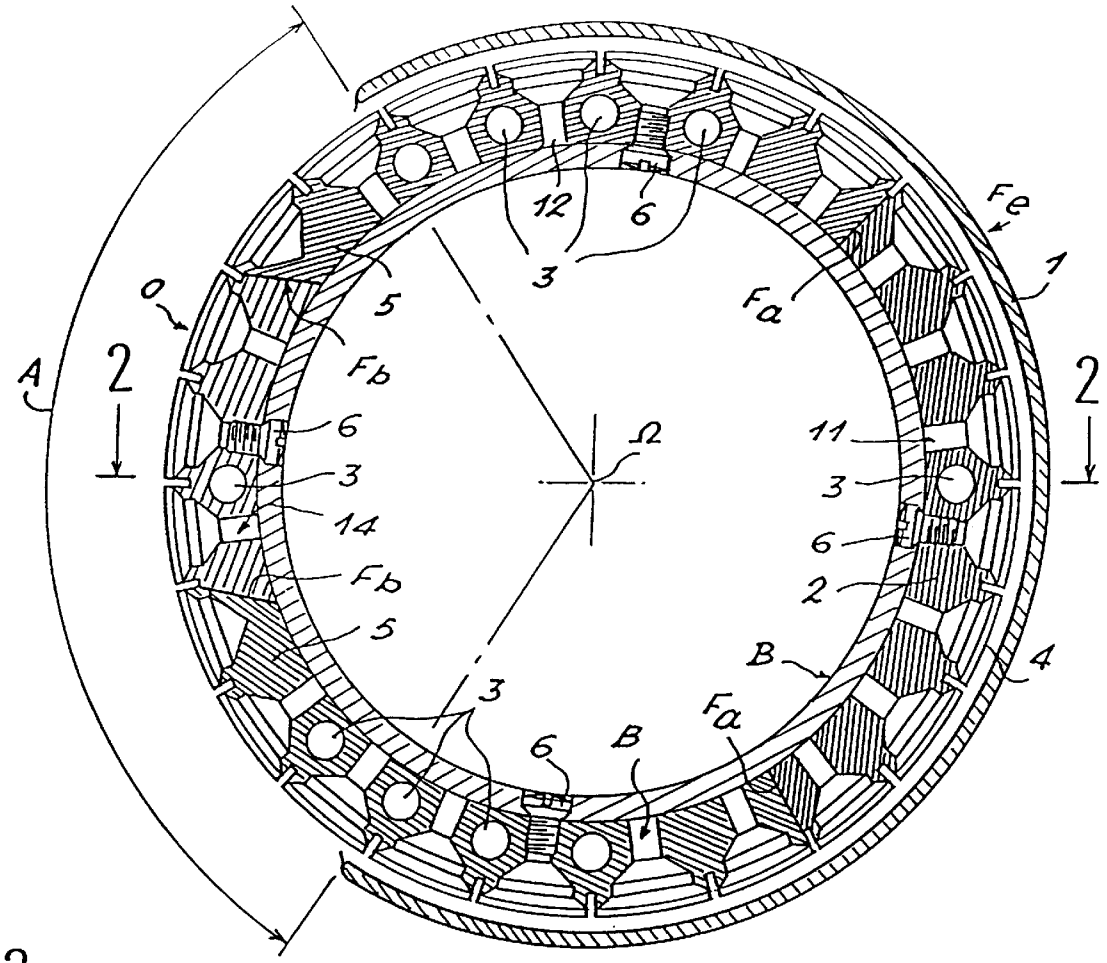
FIG. 1, an embodiment of a structure according to the invention for a stone-lined ring seen in section through the mid-plane of symmetry along line 1—1.
Figure 2:
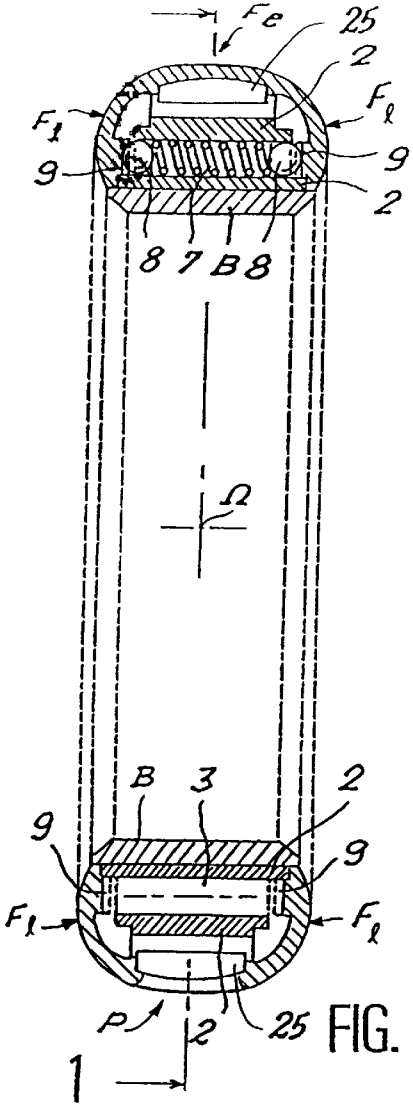
FIG. 2, a section through a central plane defined by line 2—2 perpendicularly to the mid-plane of the structure according to FIG. 1.

FIG. 1 depicts a particular embodiment of the invention applied to a stone-lined ring seen in section through a mid-plane of symmetry P (indicated in the sectional view depicted in FIG. 2). The ring is formed by an outerly annualar structure consisting of a hoop 1. In this figure, the hoop coincides with the trace of its external face ($F_e$) centred at Ω. The hoop 1 exhibits an opening O of centre angle A, with a value of about 120°. The hoop 1 houses, in this embodiment, an annulus of four carriers 11, 12, 13 and 14. Each carrier possesses setting elements 2 certain of which exhibit a bore 3. Precious stones are set by two adjacent elements 2.

Each carrier exhibits a curved shape, a length and end faces adapted for good insertion into the hoop;

the carrier 11 possesses six setting elements, one of which is drilled, and two setting half-elements arranged at each end of the carrier 11 and the external faces of which form the faces $F_a$ for uniting with the adjacent carriers 12 and 13;

the carriers 12 and 13 have five setting elements 2, four of which are bored and, at their ends, on one side a setting half-element juxtaposed with the uniting faces $F_a$ of the carrier 11, and on the other side a setting element 5 extended by a fraction of a setting element, this fraction being less than ½; the extensions of the elements 5 have a substantially plane external face serving as united face $F_b$;

the carrier 14 includes two whole setting elements, one of which bored, and two divided endmost setting elements complementary with the extensions of the elements 5 of the carriers 11 and 12 so that the carrier 14 can be inserted against the united faces $F_b$.

In the particular embodiment as illustrated, the uniting faces $F_a$ are radial with respect to the centre Ω, and the uniting faces $F_b$ are not radial. The presence of tilted uniting faces $F_b$ makes it possible to enlarge the angular space seen from the point Ω, which space is available to the carrier 14 for its insertion. The inclination of the faces $F_b$ thus aids this insertion and, furthermore increases the securing together of the carriers once the carrier 14 is inserted. An internal ring B is dimensioned so as to be adjoined against the carriers 11 to 14. The internal ring is fixed to each of these carriers by a screw 6 whose tapping is made between two setting elements of these carriers. This internal ring makes it possible, on the one hand, to secure the carriers together and, on the other hand, to aid the rotation of the mount thus secured, as detailed below.

In section through the trace plane defined by line 2—2 in FIG. 1, FIG. 2 shows the hoop 1 composed of the lateral faces $F_1$ and of the external face $F_e$. The lateral faces $F_1$ delimit the gap of the opening O of the presentation window. The setting elements 2 exhibit bores 3, one of which is occupied by pressure means consisting of a spring 7 flanked by balls 8. The spring 7 exerts a pressure against the lateral faces $F_1$ via the balls 8 in such a way as to be able to come into abutment against pairs of notches 9 made in these lateral faces.

Also appearing in FIG. 2 is the circular ring B which will be wedged against an internal face of the setting elements 2 and the lateral faces $F_1$ of the hoop 1. The inner ring B is dimensioned so as to engage a cylindrical opening 25. The mount structure composed of the hoop 1, the setting elements 2 and the internal ring B possesses central symmetry which respect to the point Ω. The compass of the lateral faces $F_1$ and of the setting elements 2 is suggested by the dashed lines in FIG. 2, which indicate the limits of these faces and elements in a plane close to the plane defined by line 2—2.

The number of notches made, for instance, by stamping on the lateral faces and the number of bored elements able to receive pressure means are adapted so as to make it possible to produce a desired number of different assortments of stones presented in the window of opening O. Preferentially, the number of ball-spring pressure assemblies is equal to four; these assemblies are arranged in two setting elements which are diametrically opposed with respect to the centre Ω.

In the embodiment illustrated in FIGS. 1 and 2, six pairs of notches are regularly distributed over the lateral faces, so that an indexation over 60° is effected when the pressure means pass from one pair of notches to the next pair. The stones are distributed in three groups of different colours, for example red, green and white. By exerting light pressure on the inner ring or on the outer hoop, so as to cause pressure means to pass from one indexation to the next, in one direction or the other, the user unveils through the opening O a set of eight stones of the same colour or two sets of four stones of different colours.

Figure 3:
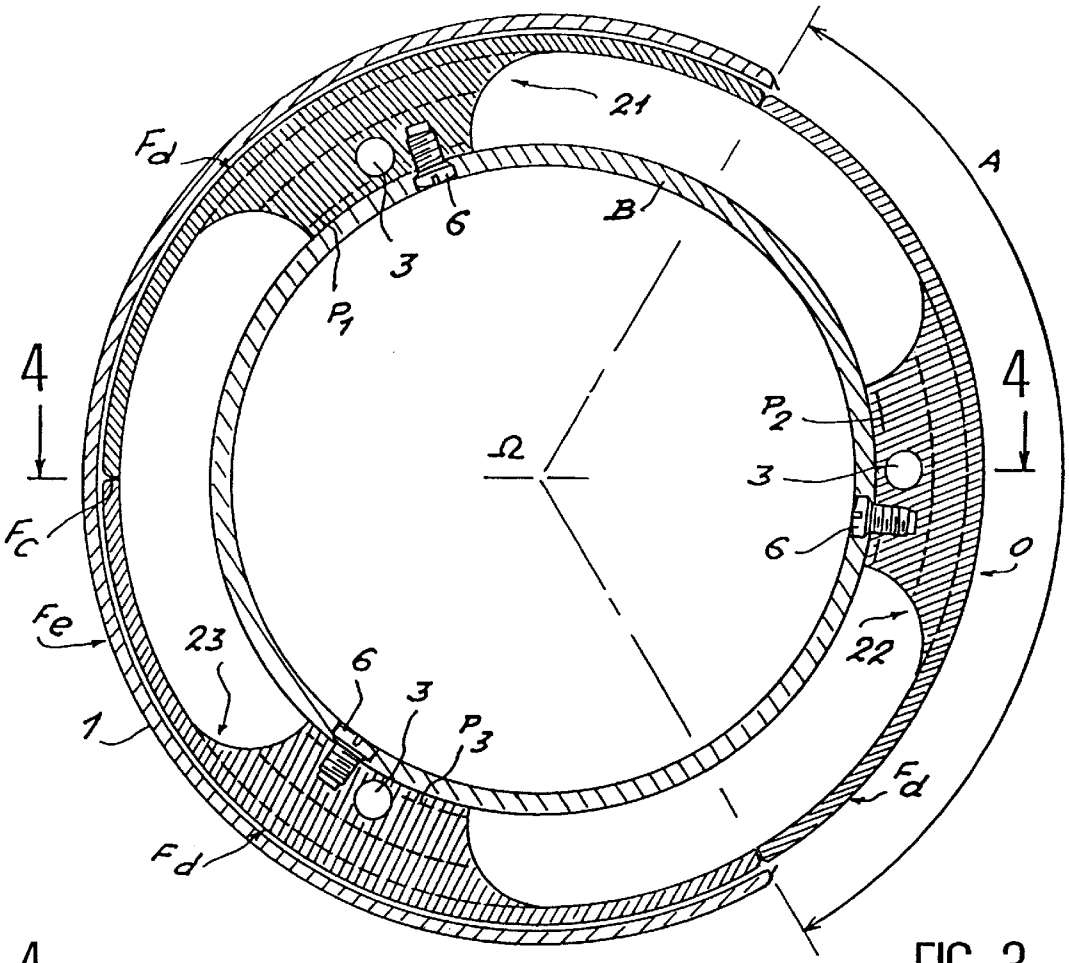
FIG. 3, another example of a structure according to the invention applied to the construction of a gold ring, seen in section through the mid-plane of symmetry along line 3—3 of FIG. 4.

FIG. 3 depicts another particular embodiment of the invention, in section through the mid-plane of symmetry P. In this embodiment, the elements of the previous embodiment have been repeated with the same reference symbols. In the embodiment illustrated in FIG. 3, the hoop 1 houses three gold carriers 21, 22 and 23 which each exhibit a face $F_d$ pointing towards the outer face $F_e$ of the hoop 1. The faces $F_d$ are substantially cylindrical over 120° so as to be able to be juxtaposed at their end and inscribed as an annulus within the hoop 1. The carriers 21 to 23 are identical and each exhibit a foot $P_1$, $P_2$ and $P_3$, in which a bore has been formed. These bores are of such dimension that the pressure means described previously may be introduced. The feet $P_1$ to $P_3$ of the carriers 21 to 23 exhibit a surface pointing towards Ω, the curvature of which is matched to the internal ring B. The ring B is fixed to each of these feet by a screw 6. The angle A of the opening O is, in this embodiment, again equal to 120°.

Figure 4:
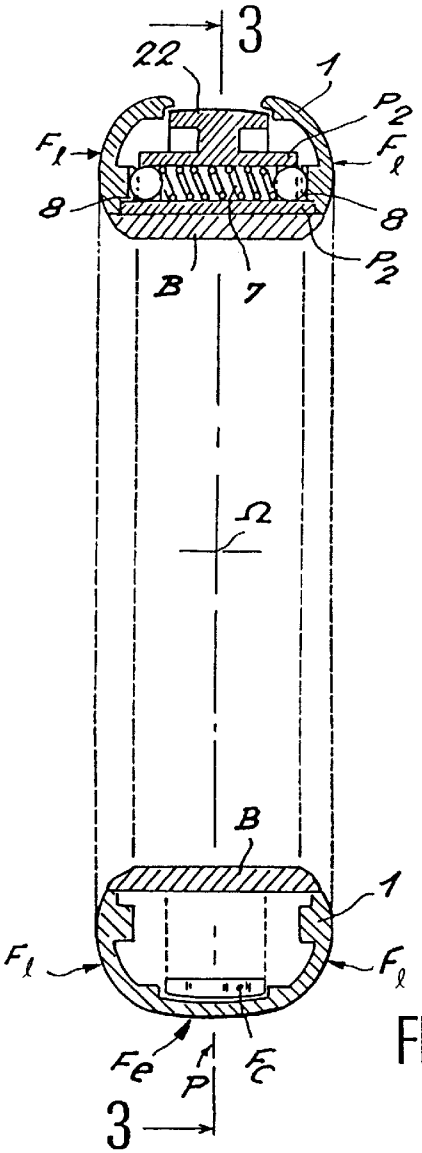
FIG. 4, a section through a central plane defined by line 4—4 perpendicularly to the mid plane of the structure according to FIG. 3.

FIG. 4 shows the annulus of FIG. 3 in section through the plane II. The elements which are identical to those of the previous figures still bear the same reference symbols. In FIG. 4, there appears, apart from the lateral faces $F_1$ and the outer face $F_e$ of the hoop 1, an end face $F_c$ of the carrier 23 which is juxtaposed with an equivalent face of the carrier 21, and a sectional view of the carrier 22 whose foot $P_2$ exhibits a bore into which the spring 7 and the balls 8 of the pressure means are introduced.

The pairs of notches are distributed over the lateral faces $F_1$ every 120° so as to be able to effect indexation corresponding to this angular gap. Thus, by rotating the internal ring B, it is possible to unveil in the opening O various decorations inscribed on the carriers, by passing from one indexation to the next indexation. Decorations or messages can be engraved on the faces $F_d$ of the carriers 21 to 23, in such a way as to vary and to alter the appearance of the annulus inside the window.

The invention is not limited to the embodiments represented and described. It is for example within the scope of those skilled in the art to effect indexation by means other than those described earlier, for example by providing retractable leaves or studs, by magnetic means (magnets) or by electric drive means assisted by a circular micrometer. It is also possible to simplify the pressure means described earlier by employing just a single ball cooperating with a single notch arranged in one and/or other of the lateral faces of the annular hoop.

Furthermore, the angle of opening of the window may vary, for example it can be taken equal to 90°, and the number of windows can be increased, it being for example possible to provide two windows with an angle of opening equal to 60°. The number of indexations is then adapted so that the desired sets of assortments appear in the opening: for example, for an opening of 90°, four indexations diametrically opposed two by two, may be preferably provided.

Moreover, the mode of fixing the internal ring may of course be adapted by those skilled in the art by using any known technique (riveting, adhesive bonding, spot welds, etc.)

What is claimed is:

1. A rotating-mount structure for the presentation of decorative elements including support means for these decorative elements and an annular base, wherein the annular base is comprised of a hoop having central symmetry, composed of an external face and of two lateral faces which are symmetric with respect to a mid-plane, said two lateral faces forming, as a border, a cylindrical opening, wherein that at least one opening is made in said external face in order to reveal a window which extends along a circular principal axis lying in said mid-plane of symmetry and defining a given angular sector, wherein the support means are composed of several distinct carriers shaped to be able to be housed within said hoop after juxtaposition and to constitute a rotating mount in order to present the decorative elements in succession through said window, and wherein an inner ring, dimensioned so as to engage against said cylindrical opening, is secured to said rotating mount.

2. Structure according to claim 1, wherein at least one of said two lateral faces is furnished with indexing means cooperating with means secured to at least one of the carriers for the successive and defined presentation of sets of decorative elements.

3. Structure according to claim 2, wherein the indexing means consist of notches cooperating with means exerting an elastic pressure, the elastic pressure means coming into elastic abutment in the notches.

4. Structure according to claim 3, characterized in that the elastic pressure means include a spring flanked by two balls, said elastic pressure means being dimensioned so as to be able to be introduced into a bore formed in at least one of the carriers.

5. Structure according to claim 1, wherein the inner ring exhibits a fixing point for each carrier.

6. Structure according to claim 1, wherein at least one of said several distinct carriers exhibit uniting faces tilted with respect to a radial line so as to enlarge the solid angle of entry available to a carrier during its insertion.

7. Structure according to claim 1, wherein said external face exhibits a single presentation window opening substantially equal to 120° or 90°.

8. Structure according to claim 7, wherein the carriers include setting elements in order to set stones.

9. Structure according to claim 8, wherein said internal ring is fixed to each of the carriers by a screw introduced into a tapping made in each carrier between two setting elements.

10. Structure according to claim 8, characterized in that the number of pressure means is equal to four, these means being arranged in setting elements which are diametrically opposed two by two with respect to the centre of symmetry.

11. Structure according to claim 1, wherein each carrier exhibits a foot on which said internal ring is fixed by a screw introduced into a tapping made in each foot.

* * * * *